US006502786B2

(12) United States Patent
Rupert et al.

(10) Patent No.: US 6,502,786 B2
(45) Date of Patent: Jan. 7, 2003

(54) 2-D PROJECTILE TRAJECTORY CORRECTOR

(75) Inventors: John G. Rupert, Minneapolis, MN (US); Jeff Siewart, North Ferrisburg, VT (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 10/060,078

(22) Filed: Jan. 29, 2002

(65) Prior Publication Data

US 2002/0117580 A1 Aug. 29, 2002

Related U.S. Application Data

(60) Provisional application No. 60/265,725, filed on Feb. 1, 2001, and provisional application No. 60/265,794, filed on Feb. 1, 2001.

(51) Int. Cl.[7] ..... F42B 10/00

(52) U.S. Cl. ..... 244/3.27; 244/3.1

(58) Field of Search ..... 244/3.24, 3.25, 244/3.26, 3.27, 3.28, 3.29, 3.3, 3.21, 3.1, 3.23; 102/529

(56) References Cited

U.S. PATENT DOCUMENTS

| | | | | | |
|---|---|---|---|---|---|
| 5,379,968 | A | * | 1/1995 | Grosso | 244/3.21 |
| 5,507,452 | A | * | 4/1996 | Mayersak | 102/384 |
| 5,657,947 | A | * | 8/1997 | Mayersak | 244/3.19 |
| 5,762,291 | A | | 6/1998 | Hollis et al. | 244/3.24 |
| 5,775,636 | A | | 7/1998 | Vig et al. | 244/3.24 |
| 5,816,531 | A | * | 10/1998 | Hollis et al. | 102/293 |
| 5,826,821 | A | * | 10/1998 | Brandon et al. | 102/293 |
| 5,886,257 | A | * | 3/1999 | Gustafson et al. | 244/171 |
| 6,135,387 | A | | 10/2000 | Seidel et al. | 244/3.15 |
| 6,234,082 | B1 | | 5/2001 | Cros et al. | 102/520 |
| 6,310,335 | B1 | * | 10/2001 | Bonnet et al. | 244/3.1 |
| 6,325,325 | B1 | | 12/2001 | Bonnet et al. | 244/3.24 |
| 6,345,785 | B1 | | 2/2002 | Harkins et al. | 244/3.23 |

FOREIGN PATENT DOCUMENTS

| | | | | |
|---|---|---|---|---|
| DE | 2650139 | * | 5/1978 | F41G/7/12 |
| WO | WO 02/14780 | | 2/2002 | |

* cited by examiner

*Primary Examiner*—Peter M. Poon
*Assistant Examiner*—Timothy D Collins
(74) *Attorney, Agent, or Firm*—Patterson, Thuente, Skaar & Christensen, P.A.

(57) ABSTRACT

A device and a method of adjusting a trajectory of a projectile in flight includes increasing projectile drag to effect a downrange correction and altering the yaw of repose to effect a cross range correction. A method of a vernier correction to the trajectory is included.

29 Claims, 5 Drawing Sheets

2-D PROJECTILE TRAJECTORY CORRECTOR

RELATED APPLICATION

The present application claims the benefit of U.S. Provisional Application Nos. 60/265,725 and 60/265,794 both dated Feb. 1, 2001.

FIELD OF THE INVENTION

The present invention relates to artillery projectiles in general and specifically to a device for correcting the range and deflection errors inherent in an unguided spin stabilized projectile.

BACKGROUND OF THE INVENTION

There is need to improve the accuracy of artillery shells fired by large bore weapons. Technological advances in metallurgy, propulsion, guidance and control now make it feasible for artillery systems to attack targets at ranges greater than 20 miles. Artillery shells, follow a ballistic trajectory, which in an ideal world can be determined mathematically from launch point to target. However, the real world is not as forgiving. Numerous factors affect the trajectory. Variations in temperature, wind and precipitation along with minute differences in manufacturing tolerances of the projectile, the barrel of the weapon, and the charge are just a few of the factors affecting the flight of a projectile. Moreover, there is typically no control of the projectile after launch. Therefore, as the range increases, the potential impact footprint of the projectile grows until it reaches the point where the projectile can no longer be relied upon to accomplish the desired mission.

There is a need then to improve the accuracy of artillery projectiles through in-flight control. One proposed solution addressed by prior art is the smart projectile, which is basically a gun-fired guided missile. These weapons are extremely complex. In addition to the normal fuze and payload found in unguided projectiles, these weapons utilize Inertial Measuring Units (IMUs) containing gyros and accelerometers, complex canard assemblies with actuator motors and drive electronics and/or variable angle rocket nozzles, and long grain rocket motors with complex finned base assemblies.

The complexity of a smart projectile results in reliability issues. The delicate components of these projectiles are subject to failure due to the high acceleration pressure, temperatures and rotational velocities experienced throughout launch and the flight. The projectile may have to be de-spun prior to flight correction in order to protect the internal components from the high rotational velocities imparted from the rifled barrels. Furthermore, accuracy in such weapons comes at a high cost. Fully guided rounds such as ERGM, XM982 and AGS LRLAP cost between $25,000.00 to $80,000.00 a piece. While simpler, less expensive corrector designs have been proposed, none provide the required two dimensions of control for range and deflection errors.

There is a further need then to efficiently utilize the inventory of current artillery pieces. Improvements to the projectile must be compatible with existing rounds. Modem artillery barrels are rifled so as to create spin in the projectile. Without spinning, the projectile has a tendency to tumble which makes it impossible to determine with any level of confidence where the projectile is going to land. One consequence of spin is that it creates a yawing to the right (with right hand refilling twist) or side slip angle called the yaw of repose. When a projectile is fired at a range of 20 miles, the yaw of repose will result in a cross range deflection of about 1 mile. In order to continue using existing weapon systems with rifled barrels, the proposed system must be able to compensate for the affects of rifling.

What is needed is a system that can provide two dimensional in-flight projectile trajectory correction more simply and less expensively than a guided projectile. Preferably the system can be used to modify the millions of artillery rounds in the existing inventory or be simply added to new artillery rounds. The system should be safe from electronic jamming, which is likely in a combat environment. The system should improve accuracy so that the corrected projectiles can be used effectively for targets at ranges in excess of 20 miles.

SUMMARY OF THE INVENTION

The present invention is a two dimensional (2-D) projectile trajectory corrector system for placement on an artillery projectile that includes multiple aerodynamic surfaces which affect drag and spin so that range and cross range deflection may be adjusted in-flight through a deployment method that may include vernier corrections. The two dimensional projectile trajectory corrector system also contains means for receiving positional data and a programmable timer for implementing the deployment strategy necessary for trajectory adjustment.

BRIEF DESCRIPTION OF THE DRAWINGS

The present invention is a device and a method of adjusting a trajectory of a projectile in flight comprising increasing projectile drag to effect a downrange correction and altering the yaw of repose to effect a cross range correction.

DETAILED DESCRIPTION OF THE DRAWINGS

Figure 1:
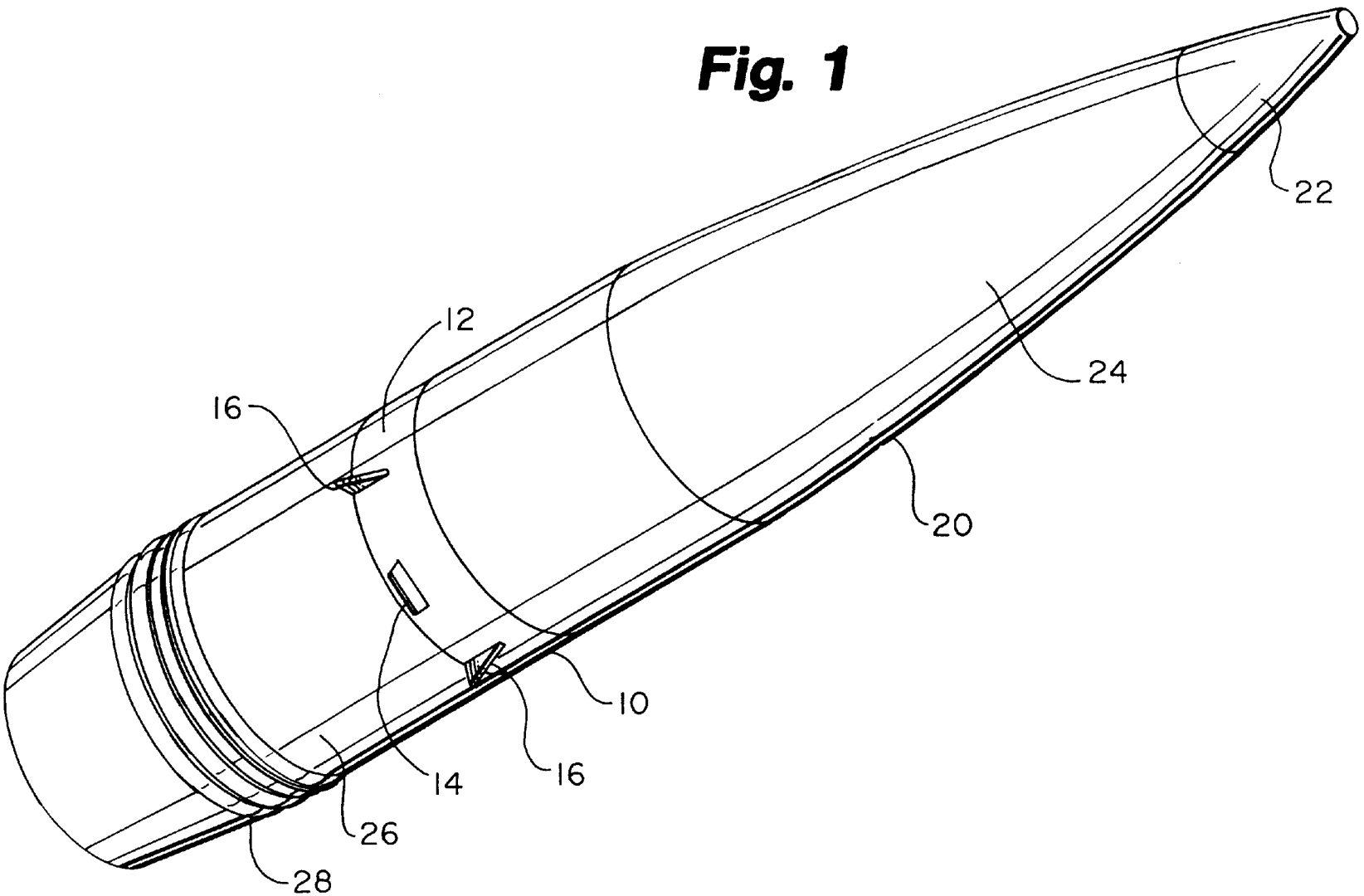
FIG. 1 is a perspective view of the present invention in the center position as retrofitted to an existing M549 projectile with representative spin and drag tabs extended.

Generally, the 2-D projectile trajectory corrector system includes two types of aerodynamic surfaces which deploy from the projectile so as to affect the spin stabilized flight characteristics inherent in a round fired from a rifled barrel. The first type of surface, which provides one-dimensional range correction, is a drag device that acts as an airbrake. These devices are stored within the projectile at launch, then deploy radially from the projectile in-flight so as to eventually lie substantially perpendicular to the line of flight. The timing and sequence of deployment of the drag devices determines the reduction in range.

The second type of surface, which provides the second dimension of cross range correction, affects spin and the normal force of the projectile in-flight. The spin device is also stored within the projectile at launch, then deploys radially from the projectile surface but is positioned generally parallel with an angle of attack relative to the line of flight. The spin device is a relatively small swept wing or tab canted at an angle off the streamlined position so as to generate lift to enhance or decrease the spin. The timing and sequence of deployment of the spin devices determines the amount of cross range correction.

Deployment of the aerodynamic surfaces is preferably accomplished through firing simple gun-hard pyrotechnic pistons, which force the devices radially from the projectile. This action, combined with the centrifugal force created by the spin of the round, drives the aerodynamic surface out of its chute, through a protective seal, to an active setting. The command to deploy is determined by a system which calculates current trajectory, compares it to the trajectory needed to impact the target, and calculates an adjustment strategy. Deployment commands may be staggered so as to provide initial launch error correction and vernier correction for deviations that develop throughout the flight.

The timing of the command to deploy is critical to the correction method. Infinitesimal trajectory errors at launch can result in tremendous errors over a flight span of 20+miles. The present invention leverages the time of flight for a passive correction technique utilizing the aerodynamic characteristics of a spin stabilized projectile. Range is easily decreased by increasing the drag through an increase of the surface area of the projectile with respect to the direction of flight. The present invention increases drag by deploying surfaces generally perpendicular to the line of flight. The drag surfaces are simply airbrakes. A deployment early in the flight allows for the use of smaller surfaces for they have a longer time to affect the trajectory. Additional increases in the surface area later in-flight provide a residual correction or vernier correction.

Likewise, the present invention leverages the physics of a spinning body to vary the deflection. Cross range deflection is affected by two parameters; the pitching moment coefficient and the normal force coefficient. First, a spinning body produces a normal force proportional to its yaw angle in the airstream. The yaw angle, often referred to as the yaw of repose, is proportional to the spin rate. A spin damping device will lower the spin rate and the yaw angle which results in less cross range deflection. Note that a change in spin rate does not occur immediately upon deployment of the spin surfaces. There is a dynamic lag while the projectile decelerates which is taken into account in the deployment calculations.

Second, deploying aerodynamic surfaces affects the pitching moment which in turn affects stability. The effect varies with location of the aerodynamic surface as related to the center of gravity of the projectile. Placing fins on the tail of a projectile makes it more stable, like the fletching on an arrow, while fins placed forward of the center of gravity decrease stability. A standard artillery right twist barrel produces a spinning projectile with a drift to the right, which is proportional to the yaw of repose. The yaw of repose varies inversely with the pitching moment coefficient. Finally, the spin surfaces, which preferably have a swept wing appearance, provide some lift to the projectile. The cross range drift is proportional to the lift on the projectile. In summary, adding fins to the projectile can alter cross range deflection by changing the spin rate, by changing the lift and by changing the pitching moment.

The present invention provides a method and apparatus for effecting two-dimensional in-flight course correction for artillery shells by deploying pairs of aerodynamic surfaces which affect range and cross range deflection, respectively, to place the projectile on a trajectory which will impact the target. The deployment of the aerodynamic surfaces is preferably determined by a fire control system on the ground in which a projectile tracking radar is used to measure position and velocity of the projectile, calculate course corrections, and uplink commands to the projectile. This method is preferred for it reduces the complexity and quantity of the command/control equipment within the projectile. The 2-D projectile trajectory corrector module then only contains a receiver and a programmable timer to process the commands and deploy the aerodynamic surfaces. Alternatively, the fins may be controlled using a GPS receiver and on-board microprocessor to make the deployment calculations.

A vernier correction method is utilized in which multiple deployments of aerodynamic surfaces are made. In a preferred embodiment, each aerodynamic surface has at least one intermediate setting and a fully deployed setting. An initial deployment occurs shortly after launch. Fine targeting corrections, to remove residual errors which develop during flight, is made by deploying selected surfaces to their fully deployed positions later in-flight. Alternatively, additional sets of aerodynamic surfaces maybe included so that the initial correction involves deploying one set of aerodynamic surfaces to a fully deployed position while fine correction is accomplished by deploying one or more additional sets of aerodynamic surfaces to a fully deployed position later in the flight.

While drag is increased by simply increasing the exposed surface area of the drag tabs, residual deflection control requires deployment of tabs which will further decrease the spin rate. Therefore, the tab angle of attack will have to be alterable for initially deployed tabs or subsequent additional deployment will occur with tabs having a fixed angle of attack designed to further reduce the spin rate. Clearly, all of the aerodynamic surfaces could have multiple deployment settings so that many corrections could be made during flight.

In the preferred embodiment, the aerodynamic surfaces are set in a module to deploy at a fixed angle of attack relative to the direction of flight. For example, at least one pair of surfaces will lie nearly perpendicular to the line of flight so as to increase drag and at least one pair will lie nearly parallel to the line of flight but having a selected angle of attack so as to change the spin rate. This design is preferred due to the simplicity of the design, limited space within the projectile, cost and reliability. In an alternative embodiment, the aerodynamic surfaces could be motor driven so that multiple angles of attack are possible.

In a first embodiment of the present invention, a 2-D projectile trajectory corrector module containing multiple pairs of aerodynamic surfaces, (i.e. spin and drag tabs), a receiver and a programmable timer, which processes the directions and deploys the aerodynamic surfaces accordingly, would be retrofitted to an existing artillery round such as the M864 or M549 rounds for use with 155 mm artillery pieces. These rounds are approximately 35 inches in length yet can be stretched to 39 inches (1 meter) and still be fired by existing and planned artillery pieces. The size of the 2-D projectile trajectory corrector system aboard the projectile would be limited to a cylinder four inches in length with a diameter complimentary to the aerodynamic shape of the retrofitted rounds. The tabs, as originally mounted are internal or flush with the periphery of the projectile. During deployment, the tabs are driven to an active aerodynamic position by firing gun hard pyrotechnic pistons. To mate the present invention to an existing round, the warhead is unscrewed from the body and a guidance section containing the present invention is inserted. The projectiles' rocket motor is then attached. This design does not require any changes to the current fuze, warhead or rocket design. Advantageously, none of these components has to be regulated.

In a second embodiment of the present invention a 2-D projectile trajectory corrector module containing multiple pairs of aerodynamic surfaces, (i.e. spin and drag tabs), a receiver and a programmable timer which processes the directions and deploys the aerodynamic surfaces accordingly is installed in the ogive position on a projectile, immediately aft of the fuze assembly. One advantage of such a placement involves decreasing the distance of the corrector from the center of gravity which advantageously affects the pitching moment and can be used to decrease deflection. Additionally, with the spin tabs mounted on the periphery of the projectile the spin tab size can be minimized due to the fact that they have a larger moment arm about the spin axis. The 2-D projectile trajectory corrector system has a diameter that is complimentary to the aerodynamic shape of the round while the length of the cylinder is limited by the acceptable overall length of the projectile for the respective weapon. The tabs, as originally mounted are internal or flush with the periphery of the projectile and deployed by pyrotechnic pistons.

In a third embodiment of the present invention, the 2-D projectile trajectory corrector module contains single pairs of aerodynamic surfaces, (i.e. spin and drag tabs), the receiver and the programmable timer which processes the directions and deploys the aerodynamic surfaces accordingly will be installed within the fuze assembly of an existing round. From an economic standpoint, this location allows the 2-D projectile trajectory corrector to be installed on millions of existing rounds. A further advantage of such a placement involves the distance of the corrector surfaces from the center of gravity which affects the pitching moment and can be used to decrease deflection. However, the spin tabs mounted on the periphery of the projectile have to be larger than the central body and ogive positions due to the fact that they have a smaller moment arm about the spin axis.

The size of the 2-D projectile trajectory corrector system mounted within the fuze is limited. The fuze may be lengthened, but overall length of the projectile must not exceed 1 meter, and while diameter of the fuze increases from the nose to the aft portion, internal space is at a premium due to the necessary fuze components. The tabs, therefore are limited to single pairs which pivot from the body of the projectile but have at least two settings.

In practice, target coordinates are determined and the projectile, fitted with the present invention, is fired with an initial aim point down range and to the right of the target. With the corrector surfaces mounted forward of the center of gravity, the spin tabs are used to decrease spin which results in less deflection, thus the spin tabs draw the projectile to the left. In the preferred embodiment of the present invention, the trajectory of the projectile is calculated by a radar system either coincident to the weapon or a stand alone radar system. Based on the tracking results, commands are uplinked to the projectile for an initial deployment of the drag and spin tabs to eliminate errors caused by muzzle exit velocity and elevation error. The tracking radar maintains contact with the projectile throughout the flight. Consequently, additional deployments of drag and spin tabs are made to remove residual errors. Through the present invention, the projectile can be guided to either strike within an acceptable distance from the target or, if the projectile is clearly off course due to weather or the target has moved, the projectile can be directed to impact in a safe area.

The 2-D projectile trajectory corrector system of the present invention is shown generally at 10 in the figures. It is generally comprised of an annular support structure 12, drag tabs 14, and spin tabs 16. In a first embodiment, depicted in FIG. 1, the preferred projectile onto which the present invention is retrofitted is designated a M549 rocket assisted projectile 20. The projectile 20 is comprised of a fuze assembly 22, a warhead 24, a rocket assembly 26, and an obturator band 28 whose diameter is slightly greater than the projectile 20. The obturator band 28 imparts the rotation to the projectile 20 as it follows the rifling of the barrel. The 2-D projectile corrector 10 is installed forward of the obturator 28, between the warhead 24 and rocket assembly 26. As depicted in FIG. 1, the spin tabs 16 and drag tabs 14 are deployed.

Figures 2, 3:
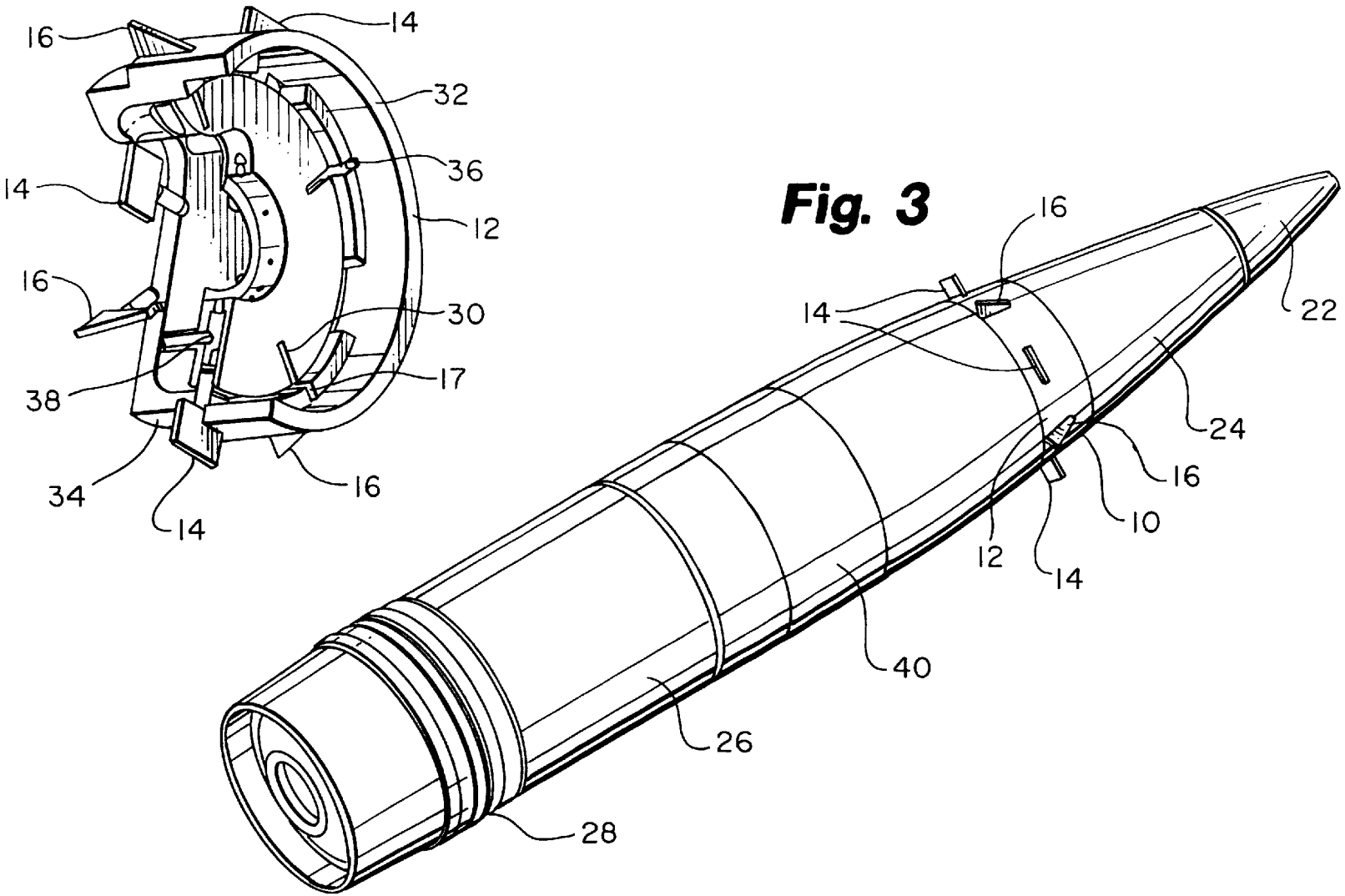
FIG. 2 is a perspective sectional view of the guidance and control subsystem of the present invention for placement in the central or ogive position with a front cutout in which the tabs remain but the structure is removed.
FIG. 3 is a perspective view of the present invention in the ogive position with representative, spin and drag tabs extended.

FIG. 2 depicts a cut away view of the annular support structure 12 of the 2-D projectile trajectory corrector 10. Detailed specifications as to the thickness and diameter of the annular structure 12 are well known to those skilled in the art for they correspond with dimensions and design tolerances of the M549 round 20. The annular structure 12 maintains the same outer diameter as the adjacent sections of the projectile 20. The thickness of the support body 32 corresponds to that needed to withstand the longitudinal and radial pressures associated with initial launch and subsequent firing of the rocket assembly structure 26. Note that placement of the projectile trajectory corrector 10 forward of the obturator band 28 avoids the extreme conditions aft of the obturator band 28 seal, which exist in that region due to the propulsion of the projectile 20.

The aerodynamic tabs 14, 16 are housed in a fixed position within a deployment ring 34 prior to launch. As shown in the first embodiment, the drag tabs 14 are preferably rectangular while the spin tabs 16 preferably have a streamlined triangular shape with the base of the triangle on the aft end and a restraining pin 36 mounted on the fore end which holds the tab 16 in its slot 17 when fully deployed. The tabs 14, 16 are located within individual chutes 30. The tabs 14, 16 are deployed by firing a gun hard pyrotechnic piston 38, the detailed specifications of which are well known to those skilled in the art. The piston 38 drives the tabs 14, 16 down their respective chutes 30 and through a protective seal in the slot 17 to the desired deployment. In this embodiment there are multiple sets of spin tabs 16 and drag tabs 14. The vernier effect is accomplished by deploying at least one opposing set of tabs 14, 16 for the initial correction and at least a portion of the remaining tabs 14, 16 for residual correction.

In a second embodiment, as depicted in FIG. 3, the projectile 40 onto which the present invention 10 is fitted is an advanced 155 mm round 40 for the Advanced Gun System (AGS). The AGS, originally designed to support the US Navy's DD 21 land-attack destroyer program, is capable of engaging targets at ranges in excess of 40 miles. The projectile 40 is comprised of a fuze assembly 22, a warhead 24, a rocket assembly 26, and an obturator band 28. The 2-D projectile trajectory corrector system 10 is installed behind the fuze 22 in the ogive position of the projectile 40. As depicted in FIG. 3, the multiple sets of the spin tabs 16 and drag tabs 14 are deployed. The annular structure 12 is tapered from fore to aft to maintain the same outer diameter as the adjacent sections of the projectile 40. The thickness of the annular structure 12 corresponds to that needed to withstand the radial and axial pressures associated with initial launch and subsequent firing of the rocket assembly structure.

The aerodynamic tabs 14, 16 are housed in a fixed position within the annular ring 12 prior to launch. The drag tabs 14 are preferably rectangular in shape while the spin tabs 16 preferably have a streamlined triangular shape with the base of the triangle on the aft end. The tabs 14, 16 are located within individual chutes 30 to which a piston 38 is attached (See FIG. 2). The tabs 14, 16 are deployed by firing the gun hard pyrotechnic piston 38. The piston 38 drives the tabs 14, 16 down its respective chute 30. In this embodiment there are multiple sets of spin tabs 16 and drag tabs 14 so the vernier effect is accomplished by deploying at least one opposing set of tabs 14, 16 for the initial correction and at least a portion of the remaining tabs 14, 16 or less for residual correction.

Figure 4:
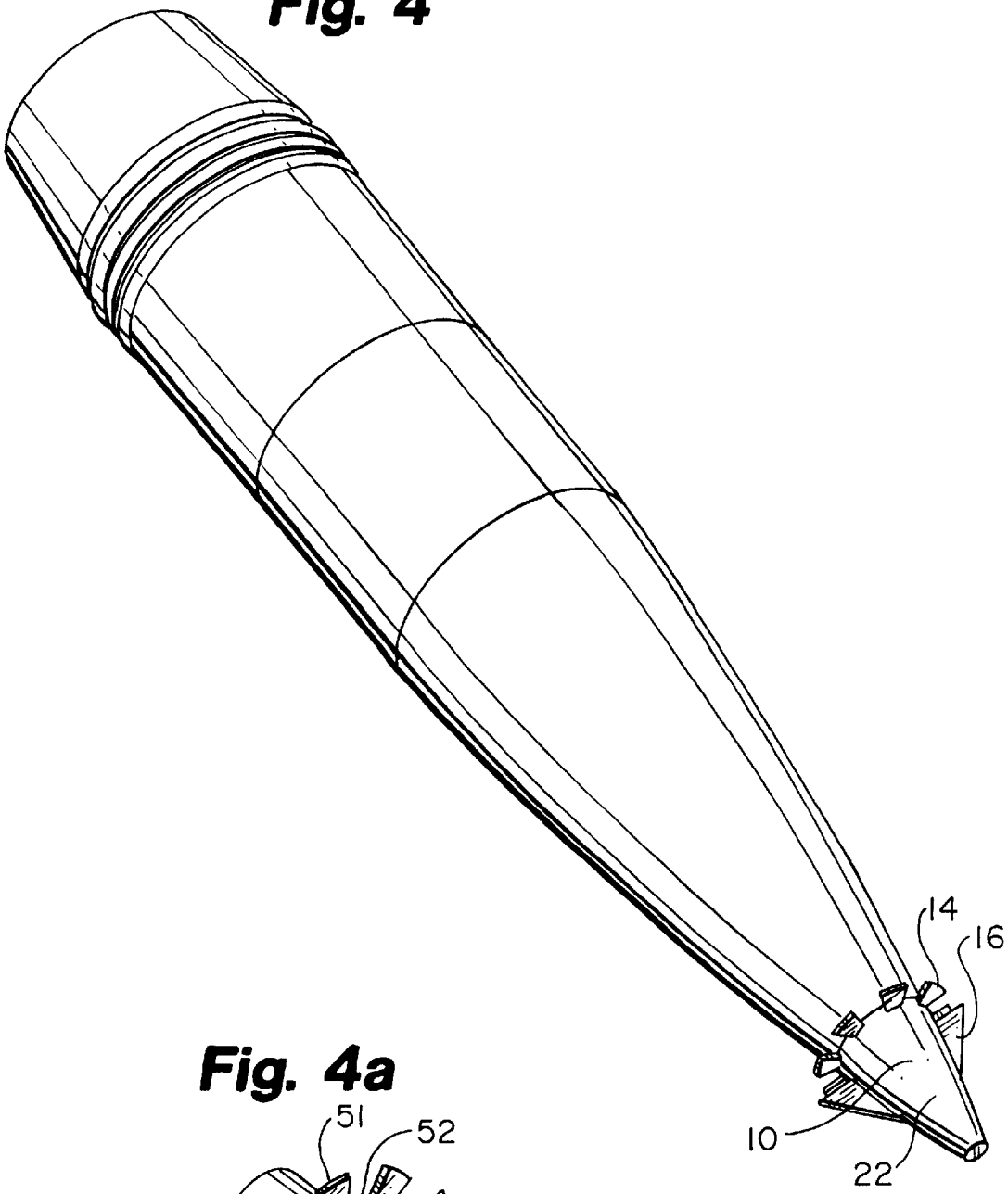
FIG. 4 is a perspective view of the present invention in the fuze position on the projectile with representative spin and drag tabs extended.
Figure 4A:
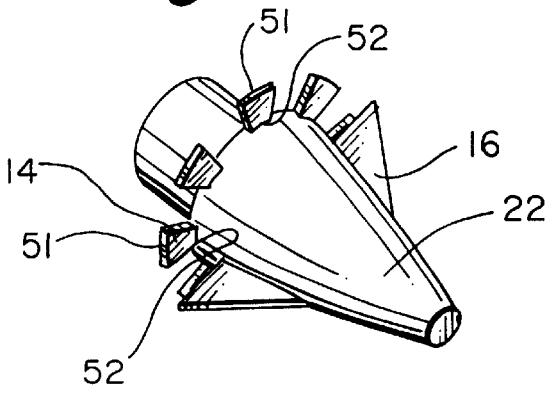
FIG. 4A is a perspective view of the fuze of FIG. 4.

In an alternate embodiment, the present invention could be retrofitted to any projectile through the use of a specially designed fuze which incorporates both spin and drag inducing surfaces. FIG. 4 depicts a 2-D projectile trajectory corrector system 10 which is incorporated into a new fuze design. Because of space constraints within the fuze assembly 22 there is only room for two spin tabs 16. The surface area of the individual spin tabs 16 must be greater than the previously described embodiments where multiple tabs 14,16 are used (See FIGS. 1 and 3). The tabs 16 are depicted in FIG. 4 as fully deployed. The shape of the spin tabs 16 is generally triangular with the base at the aft end. The leading edge of the spin tab 16 has a swept wing so as to reduce drag.

When only two spin tabs 16 exist, the vernier effect is accomplished by a spin tab 16 design which incorporates at least two deployment settings so as to provide initial and residual trajectory correction. The initial correction may be accomplished by partial deployment of the spin tab 16. Residual correction is accomplished by achieving a full deployment setting of the spin tab 16 with a new angle of attack at the appropriate point along the trajectory.

Figure 5A:
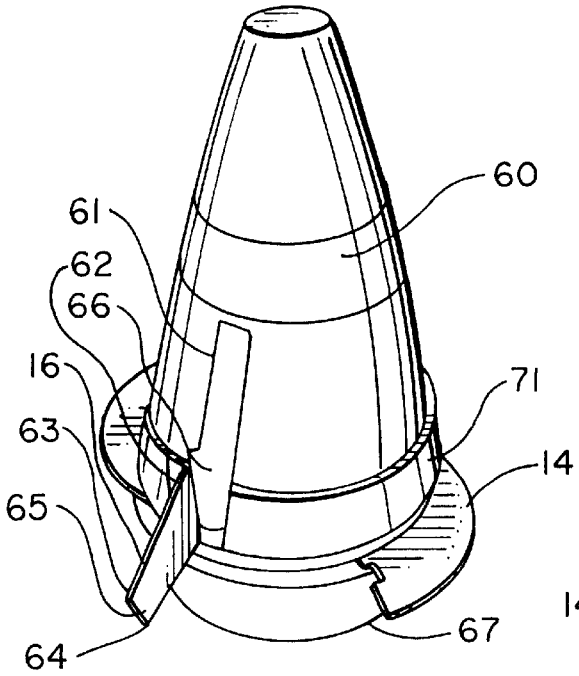
FIG. 5A is a perspective view of an alternate embodiment 2-D projectile trajectory corrector system incorporated into the fuze assembly with spin and drag tabs deployed.
Figure 5B:
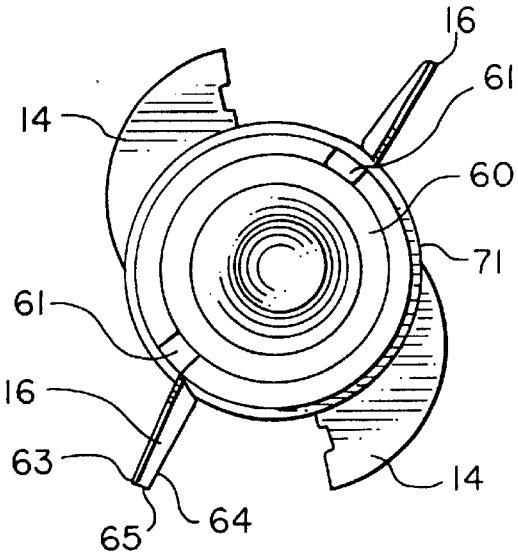
FIG. 5B is a front elevational view of the alternate embodiment of the 2-D projectile trajectory corrector system incorporated into the fuze assembly with spin and drag tabs deployed.
Figure 6A:
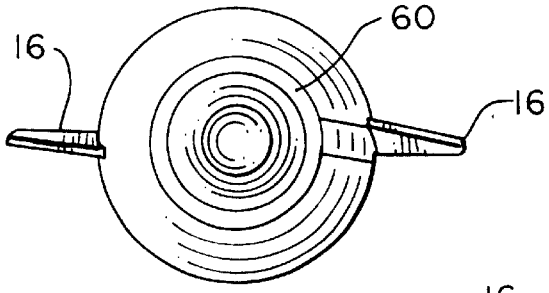
FIG. 6A is a front elevational view of the alternate embodiment of the 2-D projectile trajectory corrector system incorporated into the fuze assembly with spin tabs deployed in the spin up position.
Figure 6B:
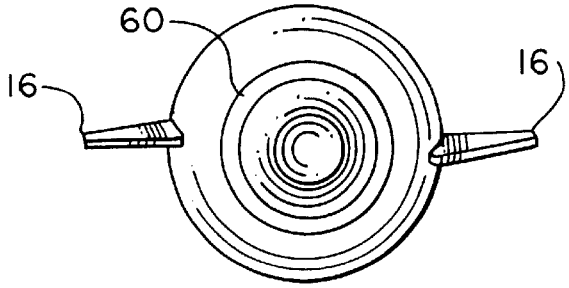
FIG. 6B is a front elevational view of the alternate embodiment of the 2-D projectile trajectory corrector system incorporated into the fuze assembly with spin tabs deployed in the spin down position.

An alternate fuze design embodiment 60, is depicted in FIGS. 5 and 6, is comprised of one set of drag tabs 14 and one set of spin tabs 16. Spin tab 16 must have a variable angle of attack setting in order to provide residual correction. FIGS. 5A and 5B depict a swept wing shaped spin tab 16 fully deployed. The tab 16 is stored pre-launch in chute 61. The spin tab wing tip 65 has a leading edge 63 with extends outboard greater than the trailing edge 64 so as to facilitate rotation out of the tab chute 61. The wing shaped tab 16 is released by a pyrotechnic piston (not shown) internal to the fuze assembly 22 which pushes the tab 16 out of the chute. Centrifugal force from the spinning projectile rotates the tab 16 about the leading edge 63 of the tab root 66 through a pivot (not shown) to a fully deployed position.

Initially, spin tab 16 is in a streamlined position which does not influence the spin characteristics of the projectile, accept to minimally increase drag. The leading edge of the tab root 66 is mounted within a fitting 62 which can pivot about the streamlined position. The fitting 62 allows the tab 16 to be rotated so as to spin up, FIG. 6A, or spin down, FIG. 6B, the projectile. Putting a spin up torque on the projectile increases the draft of the projectile to the right. The aft end of the tab root 66 extends aft of the fitting 62 and is radially displaced from the fuze body 22 so as to facilitate rotation about fitting 62. In addition, the fitting 62, is designed for multiple settings in order to increase or decrease spin for correction of residual error. The rotation of the fitting may be made to preset angles through firing a pyrotechnic piston or allow for any variation by way of an electric motor.

The drag tab surfaces 14 are also subject to space constraints when incorporated into a fuze 60. FIGS. 4 and 5 depict two separate approaches. FIG. 4 depicts multiple smaller drag tabs 14 radially deployed around the base of the fuze 60. Note that the individual tabs are shaped to maximize surface area within the constraints of the diameter of the fuze. The outboard edge of the drag tab 51 is wider than inboard edge 52. The outboard edge 51 is curved so that when in the stored position, the outboard edge tracks the arc of the fuze assembly 22 proximate the tab. The inboard edge 52 is sized to correspond with the decreased radius when in the stored position. The vernier effect is accomplished by deploying at least one opposing set of drag tabs 14 for the initial correction and the remainder or less for residual correction. As depicted in FIG. 4, all of the drag tabs 14 are deployed so the projectile is in the residual correction mode.

Figure 7A:
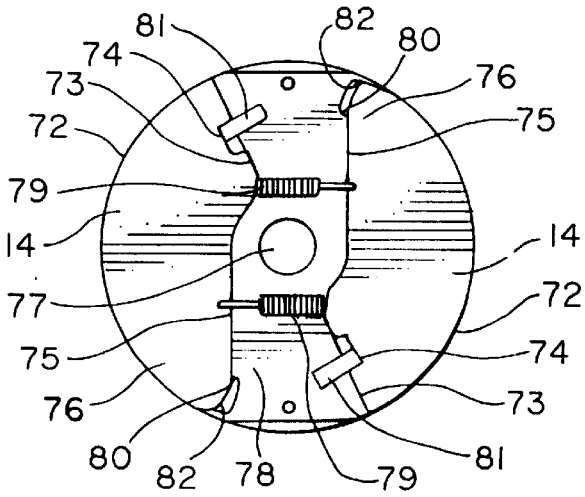
FIG. 7A is a front elevational view of the drag mechanism for the alternate embodiment of the 2-D projectile trajectory corrector system incorporated into the fuze assembly with drag tabs in a pre-launch position.
Figure 7B:
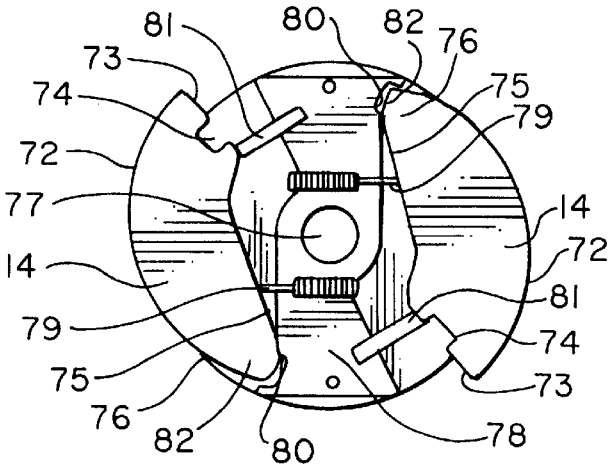
FIG. 7B is a front elevational view of the drag mechanism for the alternate embodiment of the 2-D projectile trajectory corrector system incorporated into the fuze assembly with drag tabs partially deployed.
Figure 7C:
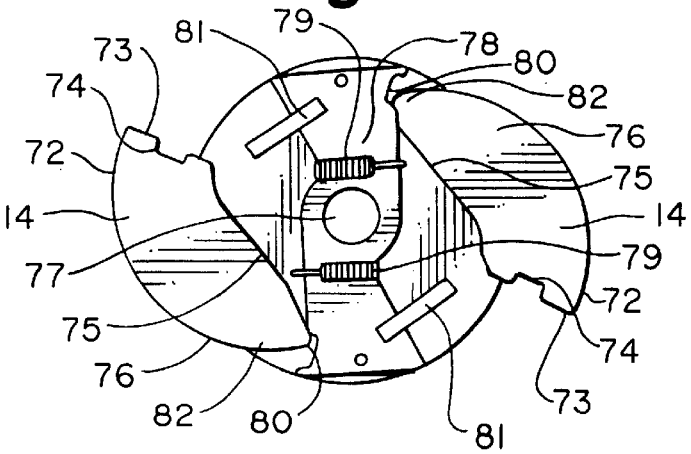
FIG. 7C is a front elevational view of the drag mechanism for the alternate embodiment of the 2-D projectile trajectory corrector system incorporated into the fuze assembly with drag tabs fully deployed.

FIGS. 5 and 7 depict an alternate drag tab 14 configuration in which only one pair of aerodynamic surfaces is deployed. In contrast to the spin tabs 16, the drag tabs 14 are deployed incrementally in two steps, FIGS. 7A–7C. The drag tabs 14 are mounted to the aft end 71 of the fuze assembly 60 so as to maximize their potential surface area and avoid the internal circuitry of the fuze. Each tab 14 is comprised of three sides: a curved outer edge 72; a radial edge 73; and an inboard edge 75. The tab rotates radially about a pivot point 76 located proximate the juncture of the outboard 72 and inboard 75 sides. The curved outer edge 72 follows the same arc as the base of the fuze 71 when in the pre-deployment position, FIG. 7A. The radial edge 73 is angled so that its tangent would bisect the center of the fuze 22.

As installed on the projectile, the drag tabs 14 are nested within slots 67 internal to the fuze with the outer edge 72 flush with the periphery of the projectile. The inner edge 75 abuts a drag tab base 78 which has the same thickness as the drag surfaces 14 and outer faces reciprocal to the inner edge 75 of the respective tabs 14. Two pyrotechnic pistons 79, one for each tab, are mounted on the drag tab base 78 for driving the tabs 14 out of their respective slots 67 upon initial deployment. As depicted in FIG. 7B, the drag tab base 78 contains two slots 81 which correspond with an interim deployment notch 74 on the radial edge 73 which allows for an interim deployment setting. The inboard edge 75 contains a hook 82 adjacent the pivot point 76 for engaging a protrusion 80 on the drag tab base 78 which acts as a stop once the drag tabs 14 reach maximum deployment. The drag tab base 78 contains a central opening 77 for passage of command and control wiring to the projectile warhead and rocket assembly which lies aft of the fuze 22.

In operation, the projectile with the present invention 10 installed is fired long and to the right of the true target due to the naturally existing yaw of repose which creates a deflection to the right. Command and control of the projectile may be accomplished through a combination of a phased array radar system and a fire control system. The fire control system may comprise a microwave link, which gives the projectile's position, a unit for calculating the trajectory and the trajectory correction vector. A ballistics computer on the ground calculates actual impact point of the projectile and extrapolate initial range and deflection corrections. Spin and drag tab 14, 16 deployment is communicated to the guidance corrector on the projectile 20 through the tracking/command radar uplink which is orders of magnitude stronger than a GPS uplink. The pyrotechnic pistons 38 fire deploying spin 16 and drag tabs 14 to their required initial position. Initial deployment of the drag tabs 14 reduce range. Initial deployment of the spin tabs 16 slowly de-spins the projectile. The lower rotational rate reduces the cross range deflection.

Additional corrections may be made in-flight to remove residual error created by the environment or flight characteristics of the projectile. The result is a range correction through either full deployment of the drag tabs 14 or deployment of additional drag tabs 14 and a decrease in deflection by deploying spin tabs 16 with a new angle of attack which will further draw the projectile 20 to the left. In the alternative, if the fire control system determines that it is impossible to reach the target based on initial launch parameters, the fire control system may direct the projectile 20 to a safe impact point.

It is obvious to those skilled in the art that other embodiments of the device and method, in addition to the ones described herein, are indicated to be within the scope and breadth of the present application. Accordingly, the applicant intends to be limited only by the claims appended hereto.

What is claimed is:

1. A 2-D projectile trajectory corrector system for improving the trajectory of a spin stabilized artillery projectile after launch, the projectile being tracked after launch by a tracking system, comprising:

a range adjustment system located within the spin stabilized artillery projectile, wherein said range adjustment system includes a plurality of radially deployable aerodynamic surfaces which increase drag by extending generally perpendicular to a central axis of the spin stabilized projectile, said aerodynamic surfaces have an arcuate structure with a pivot point integral to the projectile and a hook end which engages a corresponding groove integral to the projectile for a maximum deployment position, said aerodynamic surface actuated by a pyrotechnic piston which drives it from a recessed disposition to an exposed aerodynamic disposition, each aerodynamic surface further including an interim setting for providing an initial correction vector and a final, fully deployed setting for a residual correction vector;

a deflection adjustment system located within the spin stabilized artillery projectile; and a command module disposed within the spin stabilized artillery projectile and operably coupled to the range adjustment system and the deflection adjustment system.

2. A 2-D projectile trajectory corrector system for improving the trajectory of a spin stabilized artillery projectile after launch, the projectile being tracked after launch by a tracking system, comprising:

a range adjustment system located within the spin stabilized artillery projectile, wherein said range adjustment system includes a plurality of radially deployable aerodynamic surfaces which increase drag by extending generally perpendicular to a central axis of the spin stabilized projectile, said aerodynamic surfaces are substantially rectangular surfaces with a curved outboard edge and an inboard edge containing a lip which is engagable with the projectile in a maximum deployment position, said aerodynamic surface actuated by a pyrotechnic piston which drives it from a recessed disposition to an exposed aerodynamic disposition, the plurality of radially deployable aerodynamic drag surfaces are selectively deployed for providing an initial correction vector and a final residual correction vector;

a deflection adjustment system located within the spin stabilized artillery projectile; and a command module disposed within the spin stabilized artillery projectile and operably coupled to the range adjustment system and the deflection adjustment system.

3. A 2-D projectile trajectory corrector system for improving the trajectory of a spin stabilized artillery projectile after launch, the projectile being tracked after launch by a tracking system, comprising:

a range adjustment system located within the spin stabilized artillery projectile;

a deflection adjustment system located within the spin stabilized artillery projectile, said deflection adjustment system includes a plurality of radially deployable aerodynamic surfaces having an adjustable angle of attack, the angle of attack being adjustable during projectile flight so as to provide an initial correction vector and a residual correction vector, said aerodynamic surfaces extending generally parallel to the central axis of the spin stabilized projectile at a selected angle of attack; and a command module disposed within the spin stabilized artillery projectile and operably coupled to the range adjustment system and the deflection adjustment system.

4. The 2-D projectile trajectory corrector system of claim 3 wherein the plurality of radially deployable aerodynamic spin surfaces are adjusted by an electric motor to affect angle of attack.

5. The 2-D projectile trajectory corrector system of claim 3 wherein the plurality of radially deployable aerodynamic spin surfaces are shiftable from an interim aerodynamic position to a final aerodynamic position by an additional pyrotechnic piston.

6. A method of adjusting a trajectory of a projectile in-flight by increasing projectile drag to effect a downrange correction and altering the yaw of repose to effect a cross range correction, said method comprising:

determining a set of coordinates of a target;

firing the projectile at an initial aim point, wherein said initial aim point is down range and to the right of said target;

using a tracking system for determining a position of the projectile during flight;

calculating a trajectory for the projectile and comparing it to a trajectory required to strike the target;

providing a set of commands to the projectile to adjust said trajectory of the artillery projectile; and deploying a plurality of aerodynamic surfaces for an initial trajectory correction to range and cross range.

7. A method of adjusting a trajectory of a projectile in-flight by increasing projectile drag to effect a downrange correction and altering the yaw of repose to effect a cross range correction, said method comprising:

determining a set of coordinates of a target;

firing the projectile at an initial aim point, wherein said initial aim point is down range and to the right of said target;

using a tracking system for determining a position of the projectile during flight;

calculating a trajectory for the projectile and comparing it to a trajectory required to strike the target;

providing a set of commands to the projectile to adjust said trajectory of the artillery projectile;

deploying a plurality of aerodynamic surfaces for an initial trajectory correction to range and cross range;

monitoring trajectory after said initial correction so as to provide a set of additional trajectory correction instructions as needed; and deploying a plurality of aerodynamic surfaces for a residual trajectory correction to range and cross range; said deployment includes timing a deployment of a plurality of radially extending spin tabs with a swept wing configuration, which are positioned so as to result in selectively decreasing or increasing spin rate to respectively decrease or increase cross range deflection as desired.

8. A 2-D projectile trajectory corrector system for improving an unguided spin stabilized artillery projectile, said trajectory correction system comprising:

range adjusting means for reducing the distance the unguided spin stabilized artillery projectile travels, said means including deployment of a plurality of radially extending drag inducing surfaces;

deflection adjusting means for changing projectile cross range deflection, said means including a timed deployment of a plurality of radially extending aerodynamic surfaces which affect projectile cross range deflection by affecting projectile spin rate;

tracking means for determining the position of the projectile in-flight so as to correct trajectory errors; and vernier trajectory correction means for providing at least two stages of trajectory correction so as to correct initial and residual flight error.

9. An unguided spin stabilized artillery projectile, comprising:

a projectile body; and a 2-D projectile trajectory corrector system having:

a first set of primarily drag inducing surfaces selectively deployable in-flight to effect projectile range, wherein said surfaces are deployed in at least two steps;

a second set of primarily spin affecting surfaces selectively deployable in flight to affect projectile cross range deflection, wherein said surfaces are deployed in at least two steps; and an electronic command device operably coupled to the drag inducing and spin affecting surfaces for selectively deploying the drag inducing and spin affecting surfaces.

10. The unguided spin stabilized artillery projectile of claim 9 wherein the drag inducing surfaces, spin affecting surfaces, and command device are integral to a fuze of the unguided spin stabilized projectile.

11. The unguided spin stabilized artillery projectile of claim 9 wherein the drag inducing surfaces, spin affecting surfaces, and command device are integral to an ogive section of the unguided spin stabilized projectile.

12. The unguided spin stabilized artillery projectile of claim 9 wherein the drag inducing surfaces, spin affecting surfaces, and command device are integral to a central section of the unguided spin stabilized projectile.

13. The unguided spin stabilized artillery projectile of claim 9 wherein the drag inducing surfaces are radially deployable aerodynamic surfaces which increase drag by extending substantially perpendicular to the rotational axis of the unguided spin stabilized projectile.

14. The unguided spin stabilized artillery projectile of claim 13 wherein the plurality of radially deployable aerodynamic drag surfaces are each actuated by a pyrotechnic piston which drives the aerodynamic surface from a recessed disposition to an exposed aerodynamic disposition.

15. The unguided spin stabilized artillery projectile of claim 14 wherein the plurality of radially deployable aerodynamic drag surfaces have an interim setting for providing an initial correction vector and a final fully deployed setting for a residual correction vector.

16. The unguided spin stabilized artillery projectile of claim 15 wherein the plurality of radially deployable aerodynamic drag surfaces are arcuate structures having a pivot point integral to the projectile and a hook end which engages a corresponding groove integral to the projectile for a maximum deployment position.

17. The unguided spin stabilized artillery projectile of claim 14 wherein the plurality of radially deployable aerodynamic drag surfaces are selectively deployed for providing an initial correction vector and a final residual correction vector.

18. The unguided spin stabilized artillery projectile of claim 17 wherein the plurality of radially deployable aerodynamic drag surfaces are substantially rectangular surfaces with a curved outboard edge and an inboard edge containing a lip which is engagable with the projectile in a maximum deployment position.

19. The unguided spin stabilized artillery projectile of claim 9 wherein the plurality of spin affecting surfaces extend generally radially to the rotational axis at a selected angle of attack to affect a projectile spin rate.

20. The unguided spin stabilized artillery projectile of claim 19 wherein the plurality of radially deployable spin affecting surfaces are each actuated by a pyrotechnic piston which drives the spin affecting surface from a recessed disposition to an aerodynamic disposition.

21. The unguided spin stabilized artillery projectile of claim 19 wherein the plurality of radially deployable spin affecting surfaces have a swept wing shape.

22. The unguided spin stabilized artillery projectile of claim 19 wherein the plurality of radially deployable spin affecting surfaces have an adjustable angle of attack, the angle of attack being adjustable during projectile flight so as to provide an initial correction vector and a residual correction vector.

23. The unguided spin stabilized artillery projectile of claim 22 wherein the plurality of radially deployable spin affecting surfaces are adjusted by an electric motor to affect angle of attack.

24. The unguided spin stabilized artillery projectile of claim 20 wherein the plurality of radially deployable spin affecting surfaces are shiftable from an interim aerodynamic position to a final aerodynamic position by a second pyrotechnic piston.

25. The unguided spin stabilized artillery projectile of claim 19 wherein the plurality of radially deployable spin affecting surfaces are selectively deployed for providing an initial correction vector and a final residual correction vector.

26. The unguided spin stabilized artillery projectile of claim 9 wherein the electronic command device contains an uplink receiver and a programmable timer.

27. The unguided spin stabilized artillery projectile of claim 9 wherein the electronic command device contains a GPS receiver, a microprocessor and a programmable timer.

28. The unguided spin stabilized artillery projectile of claim 9 wherein at least a first portion of a tracking system is located within the electronic command device integral to the projectile.

29. The unguided spin stabilized artillery projectile of claim 26 wherein at least a second portion of the tracking system is located on the ground and which provides an uplink of projectile position and a deployment schedule through radar signals.

* * * * *